US012637857B2

(12) United States Patent
Cursetjee et al.

(10) Patent No.: US 12,637,857 B2
(45) Date of Patent: May 26, 2026

(54) CEILING SUPPORT SYSTEM

(71) Applicant: Nortek Air Solutions, LLC, O'Fallon, MO (US)

(72) Inventors: Zareer Cursetjee, Happy Valley, OR (US); David L. Baugh, Tualatin, OR (US); Silas J. Lortz, Tualatin, OR (US)

(73) Assignee: Nortek Air Solutions, LLC, Okarche, OK (US)

( * ) Notice: Subject to any disclaimer, the term of this patent is extended or adjusted under 35 U.S.C. 154(b) by 257 days.

(21) Appl. No.: 18/204,810

(22) Filed: Jun. 1, 2023

(65) Prior Publication Data

US 2024/0401331 A1 Dec. 5, 2024

(51) Int. Cl.

| | |
|---|---|
| ***E04B 9/12*** | (2006.01) |
| ***E04B 9/04*** | (2006.01) |
| ***E04B 9/06*** | (2006.01) |
| ***E04B 9/10*** | (2006.01) |
| ***E04B 9/30*** | (2006.01) |

(52) U.S. Cl.

CPC ..... *E04B 9/127* (2013.01); *E04B 9/0428* (2013.01); *E04B 9/067* (2013.01); *E04B 9/10* (2013.01); *E04B 9/30* (2013.01)

(58) Field of Classification Search

CPC ... E04B 9/067; E04B 9/30; E04B 9/10; E04B 9/0428; E04B 9/127

USPC ..... 52/220.6, 282.3, 506.06

See application file for complete search history.

(56) References Cited

U.S. PATENT DOCUMENTS

| | | | | | |
|---|---|---|---|---|---|
| 3,035,672 | A * | 5/1962 | Tuten | E04B 9/32 | 52/506.07 |
| 3,677,589 | A * | 7/1972 | Roles | E04B 9/127 | 52/506.07 |
| 3,798,865 | A * | 3/1974 | Curtis | E04B 9/127 | 52/715 |
| 4,710,208 | A * | 12/1987 | Ziemer | F24F 13/28 | 403/174 |
| 5,154,031 | A * | 10/1992 | Wall | E04B 9/122 | 52/506.06 |
| 5,313,759 | A * | 5/1994 | Chase, III | E04B 9/18 | 52/39 |
| 5,454,756 | A | 10/1995 | Ludwig | | |
| 5,540,028 | A * | 7/1996 | Scott | E04B 9/02 | 52/302.1 |
| 5,613,759 | A | 3/1997 | Ludwig et al. | | |
| 5,794,397 | A | 8/1998 | Ludwig | | |

(Continued)

*Primary Examiner* — Brent W Herring

(74) *Attorney, Agent, or Firm* — Schwegman Lundberg & Woessner, P.A.

(57) ABSTRACT

A cleanroom ceiling support system can include a ceiling support section. The ceiling support section can include a set of perimeter sticks, a set of interior runner sticks, a set of interior cross sticks, a first mounting bracket, and a second mounting bracket. The set of interior runner sticks can be configured to be assembled within a perimeter defined by the set of perimeter sticks and orientated in a first direction. The set of interior cross sticks can be configured to be assembled within the perimeter defined by the set of perimeter sticks and orientated in a second direction. The first mounting bracket can be configured to connect any combination of perimeter and interior sticks. The second mounting bracket can be configured to connect any combination of perimeter and interior sticks.

15 Claims, 6 Drawing Sheets

(56) References Cited

U.S. PATENT DOCUMENTS

| | | | | |
|---|---|---|---|---|
| 5,871,556 | A * | 2/1999 | Jeanseau | B01D 46/10 55/385.2 |
| 6,190,431 | B1 * | 2/2001 | Jeanseau | B01D 53/265 55/385.2 |
| 6,497,739 | B2 * | 12/2002 | McGill | F24F 3/167 454/294 |
| 7,260,919 | B1 * | 8/2007 | Spransy | E04B 9/02 52/655.1 |
| 12,031,327 | B1 * | 7/2024 | Laydera-Collins | E04B 9/183 |
| 2009/0165417 | A1 * | 7/2009 | Jankovec | E04B 9/122 52/506.07 |
| 2009/0223146 | A1 * | 9/2009 | Platt | E04B 9/10 52/745.2 |

* cited by examiner

CEILING SUPPORT SYSTEM

TECHNICAL FIELD

Examples described herein generally relate to ceiling systems. More specifically, examples described herein generally relate to ceiling support systems.

BACKGROUND

Ceiling support systems can be used in clean room environments. Clean room environments can be used for manufacturing, research, or other applications that require low contaminants such as dust, airborne microbes, and aerosol particles. The ceiling support systems can help maintain the structural integrity and functionality of the clean room while ensuring cleanliness.

Clean room ceiling support systems can be required to support many fixtures within the room, such as, for example, ceiling tiles, lighting fixtures, air filters or cleaners, or the like. Additionally, clean room ceiling support systems may have to be integrated with components of the clean room, such as, for example, walls, doors, HVAC systems, or the like. Clean room ceiling support systems may also have to also accommodate various utilities, such as, for example, electrical wiring, piping, ductwork, or the like. Thus, the clean room ceiling support system should be designed to bear the weight of any fixtures, components, utilities discussed herein, or the like. Therefore, the inventors of the present application have developed a modular ceiling system that can be used in clean rooms.

SUMMARY

In examples, a cleanroom ceiling support system can include a ceiling support section. The ceiling support section can include a set of perimeter sticks, a set of interior runner sticks, a set of interior cross sticks, a first mounting bracket, and a second mounting bracket. The set of perimeter sticks can be configured to be assembled to define a perimeter of the ceiling support section. The set of interior runner sticks can be configured to be assembled within the perimeter defined by the set of perimeter sticks and orientated in a first direction. The set of interior cross sticks can be configured to be assembled within the perimeter defined by the set of perimeter sticks and orientated in a second direction. The first mounting bracket can be configured to connect any combination of perimeter and interior sticks. The second mounting bracket can be configured to connect any combination of perimeter and interior sticks.

In examples, a mounting bracket for a modular cleanroom ceiling support system can include a set of perimeter sticks, a set of interior runner sticks, and a set of interior cross sticks. The mounting bracket can include a base extending in a first direction and including one or more apertures formed therein. The one or more apertures can be configured to receive one or more first fasteners to slidingly couple the mounting bracket to any one of a perimeter stick of the set of perimeter sticks, an interior runner stick of the set of interior runner sticks. A first wall can extend from the base in a second direction. An attachment interface can extend from the first wall and can include one or more apertures formed therethrough. The one or more apertures formed in the attachment interface can be configured to receive one or more second fasteners to fixedly couple the mounting bracket to any one of the perimeter stick of the set of perimeter sticks, the interior runner stick of the set of interior runner sticks, or an interior cross stick of the set of interior cross sticks.

In examples, a method of installing a modular cleanroom ceiling support system can include assembling a first section of the modular cleanroom ceiling support system in a first location; and installing the first section of the modular cleanroom ceiling support system in a second location. The first section can include a set of perimeter sticks configured to be assembled to define a perimeter of the first section; a set of interior runner sticks can be configured to be assembled within the perimeter defined by the set of perimeter sticks and orientated in a first direction. A set of interior cross sticks can be configured to be assembled within the perimeter defined by the set of perimeter sticks and orientated in a second direction. A first mounting bracket can be configured to connect any combination of perimeter and interior sticks. A second mounting bracket can be configured to connect any combination of perimeter and interior sticks. The second mounting bracket can be configured to secure an accessory received therethrough.

BRIEF DESCRIPTION OF THE DRAWINGS

Various examples are illustrated in the figures of the accompanying drawings. Such examples are demonstrative and not intended to be exhaustive or exclusive embodiments of the present subject matter.

DETAILED DESCRIPTION

Clean room ceilings can be supported using various systems or techniques. For example, stick-built grids can be used for clean room ceiling support because they offer modular options to customize the clean room support to match the dimensions of the room. Existing stick-built grids, primarily utilize a hub-and-stick system with a port at the intersection of the sticks. This port is not strong and can require additional support brackets or plates to allow the grid to carry the load across the intersection. Also, hanging brackets can be required on both sides of the port to support the sticks around the port. Existing stick-built grids do not allow for easy pre-assembly of the grid into modular sections before installation. Thus, the inventors of the present disclosure developed the subject matter described herein to provide a modular clean room ceiling support system that enables pre-assembly of the sticks either on site or at the factory to allow for quicker installation at site.

The clean room ceiling support system can include sections that can each be assembled in a first location and installed in a second location. Each of the sections can include a set of perimeter sticks, a set of interior runner sticks, a set of interior cross sticks, a first bracket, and a second bracket. The set of perimeter sticks can be configured to be assembled to define a perimeter of the first section. The set of interior runner sticks can be configured to be assembled within the perimeter defined by the set of perimeter sticks and orientated in a first direction. The set of interior cross sticks can be configured to be assembled within the perimeter defined by the set of perimeter sticks and orientated in a second direction. The first mounting bracket can be configured to connect any combination of perimeter and interior sticks. The second mounting bracket can be configured to connect any combination of perimeter and interior sticks. The second mounting bracket can be configured to secure an accessory received therethrough.

The above discussion is intended to provide an overview of subject matter of the present patent application. It is not intended to provide an exclusive or exhaustive explanation of the invention. The description below is included to provide further information about the present patent application. The modular ceiling support system will be discussed in more detail herein with reference to FIGS. 1-9.

Figure 1:
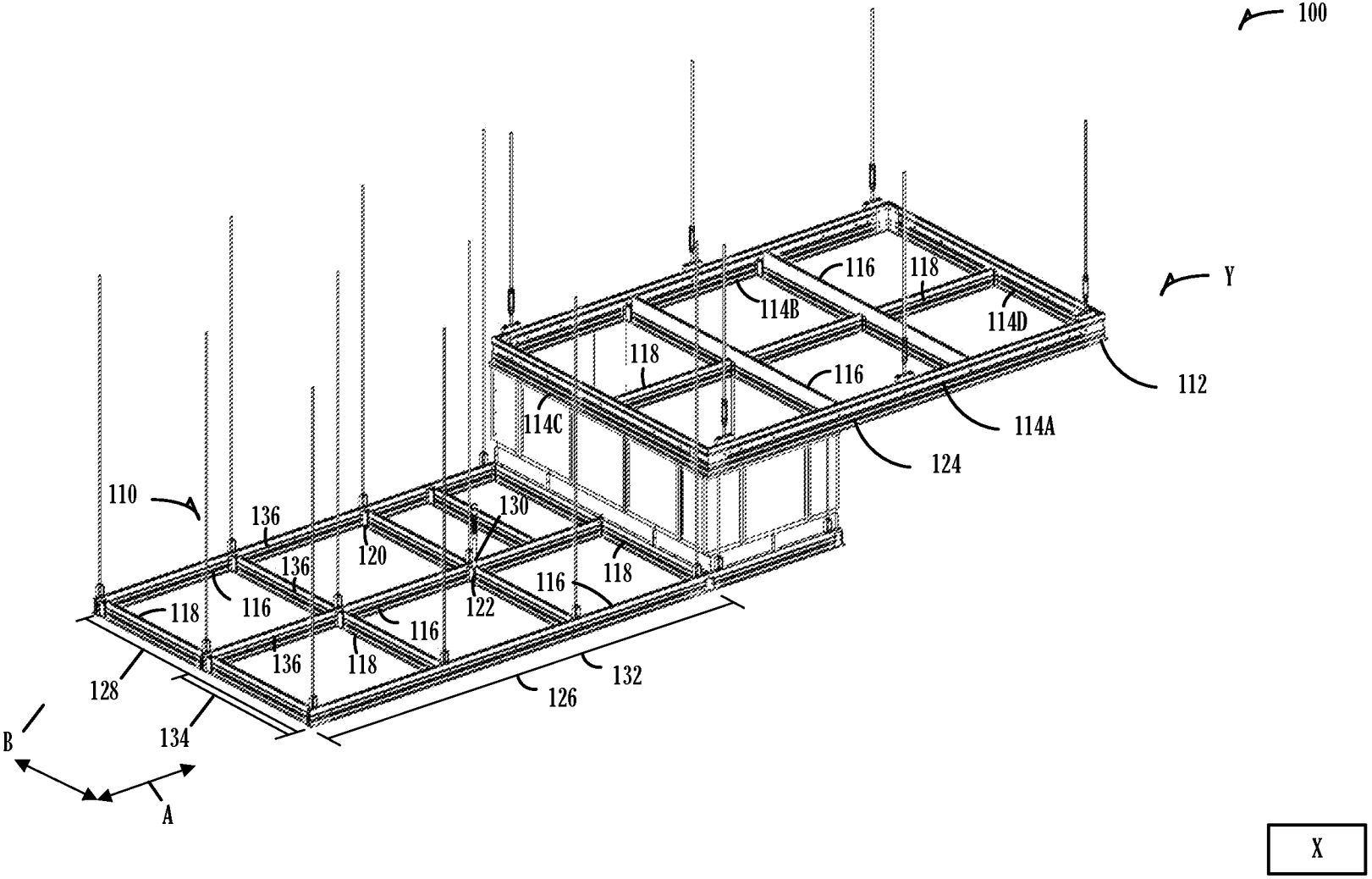
FIG. 1 is a perspective view of an example of a ceiling support system.

FIG. 1 is a perspective view of an example of a ceiling support system 100. The ceiling support system 100 can be a modular cleanroom ceiling support system that can accommodate the various components, utilities, and the like required within a clean room. The ceiling support system 100 can include a first section 110 and a second section 112. Each of the first section 110 and the second section 112 can include a set of perimeter sticks (perimeter sticks 114), a set of interior runner sticks (runner sticks 116), a set of interior cross sticks (cross sticks 118), a first mounting bracket 120, and a second mounting bracket 122.

The first section 110 and the second section 112 can each be a modular portion of a clean room ceiling support. The first section 110 and the second section 112 can be the same size or can be varying sizes to accommodate the room in which the first section 110 and the second section 112 are being installed therein. The first section 110 and the second section 112 can be assembled using the same brackets (e.g., the first mounting bracket 120, the second mounting bracket 122, or the like) or can be assembled using any combination of mounting brackets (e.g., the first mounting bracket 120, the second mounting bracket 122, or the like). Each of the first section 110 and the second section 112 can be assembled in a first location X and installed in a second location Y. The first location X can be on a floor, work bench, any location other than the final installation location, and the second location Y can be the final installation location. In examples, the first section 110 and the second section 112 can be assembled in a pre-fabrication assembly shop before they are brought to the clean room for installation in location Y.

The perimeter sticks 114 can be configured to be assembled to define a perimeter 124 of the ceiling support section (e.g., the first section 110 or the second section 112). The perimeter sticks 114 can include first perimeter stick 114A, second perimeter stick 114B, third perimeter stick 114C, and fourth perimeter stick 114D. The first and second perimeter sticks (114A and 114B, respectively) can have a first length 126 and can be assembled substantially parallel to one another. The third and fourth perimeter sticks (114C and 114D, respectively) can have a second length 128. Each of the third and fourth perimeter sticks (114C and 114D, respectively) can be connected to the first perimeter stick 114A and the second perimeter stick 114B. The third and fourth perimeter sticks (114C and 114D, respectively) can be assembled substantially parallel to one another and substantially perpendicular to the first and second perimeter sticks (114A and 114B, respectively). The first perimeter stick 114A, the second perimeter stick 114B, the third perimeter stick 114C, and the fourth perimeter stick 114D can define the perimeter 124 of the section (e.g., the first section 110, the second section 112, or any other section of the ceiling support system 100).

The runner sticks 116 can be configured to be assembled within the perimeter 124 defined by the set of perimeter sticks 114 and orientated in a first direction A (as shown in FIG. 1 for the first section 110) or in a second direction B (as shown in FIG. 1 for the second section 112). As such, the first direction A can be substantially perpendicular the second direction B.

When the runner sticks 116 are orientated in the first direction A, each of runner sticks 116 can be configured to be assembled substantially perpendicular to the third perimeter stick 114C and the fourth perimeter stick 114D and substantially parallel to the first perimeter stick 114A and the second perimeter stick 114B. When the runner sticks 116 are orientated in the second direction B, each of runner sticks 116 can be configured to be assembled substantially parallel to the third perimeter stick 114C and the fourth perimeter stick 114D and substantially perpendicular to the first perimeter stick 114A and the second perimeter stick 114B. Each of the runner sticks 116 can have a third length 132. Each of the runner sticks 116 can be assembled offset from one another within the perimeter 124 and extending between and connected to either the first and second perimeter sticks (114A and 114B, respectively) or the third and fourth perimeter sticks (114C and 114D, respectively). Each of the runner sticks 116 can be connected to the first and second perimeter sticks (114A and 114B, respectively) or the third and fourth perimeter sticks (114C and 114D, respectively) by any combination of two of the first or second mounting bracket (e.g., the first mounting bracket 120 and the second mounting bracket 122).

The cross sticks 118 can be configured to be assembled within the perimeter 124 defined by the set of perimeter sticks 114 and orientated in a second direction B (as shown in FIG. 1 for the first section 110) or in the first direction A (as shown in FIG. 1 for the second section 112). When the cross sticks 118 are orientated in the second direction B, each of the cross sticks 118 can be configured to be assembled substantially perpendicular to the first perimeter stick 114A and the second perimeter stick 114B and substantially parallel to the third perimeter stick 114C and the fourth perimeter stick 114D. When the cross sticks 118 are oriented in the first direction A, each of the 118 can be configured to be assembled substantially parallel to the first perimeter stick 114A and the second perimeter stick 114B and substantially perpendicular to the third perimeter stick 114C and the fourth perimeter stick 114D.

The cross sticks 118 can have a fourth length 134, which can be less than the third length 132 of the runner sticks 116. Each of the cross sticks 118 can be assembled within the perimeter 124 and can be connected to one of the first, second, third, or fourth perimeter sticks (114A, 114B, 114C, and 114D, respectively) and one of the runner sticks 116. Each of the cross sticks 118 can be assembled within the perimeter 124 and can be connected to a first interior runner 116A of the runner sticks 116 and a second interior runner 116B of the runner sticks 116. Each of the cross sticks 118 can be connected by any combination of two of the first or second mounting brackets (e.g., the first mounting bracket 120 and the second mounting bracket 122, respectively).

The first mounting bracket 120 can be configured to connect any combination of perimeter and interior sticks (e.g., the perimeter sticks 114, the runner sticks 116, or the cross sticks 118). The second mounting bracket 122 can be configured to connect any combination of perimeter and interior sticks (the perimeter sticks 114, the runner sticks 116, or the cross sticks 118). The second mounting bracket 122 can be configured to secure an accessory 130 received through the second mounting bracket 122. As shown in FIG. 1, the accessory 130 can be a sprinkler head. In examples, the accessory 130 can be wiring, tubing, or any other accessory used within the cleanroom that can fit within the second mounting bracket 122.

As shown in FIG. 1, the first section 110 can be stick built. Similarly, the second section 112 can also be stick built. When sections of the ceiling support system 100 are stick built, the first mounting bracket 120 or the second mounting bracket 122 can be used to secure one or more of the runner sticks 116 or the cross sticks 118 together. As such, the first mounting bracket 120 and the second mounting bracket 122 also allow stick-built sections, and the ceiling support system 100 can be customized on the job site when modular sections of the ceiling support system 100 do not fit in the room. Similarly, each of the first section 110 and the second section 112 can be modular sections made on the job site, a pre-fabrication factory, or any other location, and installed within the room.

Figure 3:
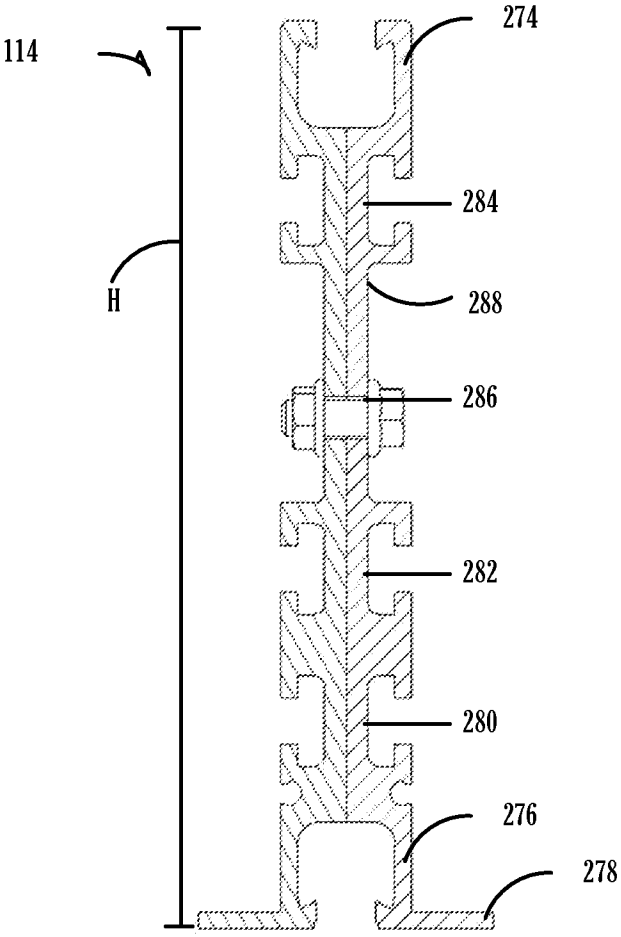
FIG. 3 is a cross-sectional view of an example of a pair of perimeter sticks coupled together.
Figure 2:
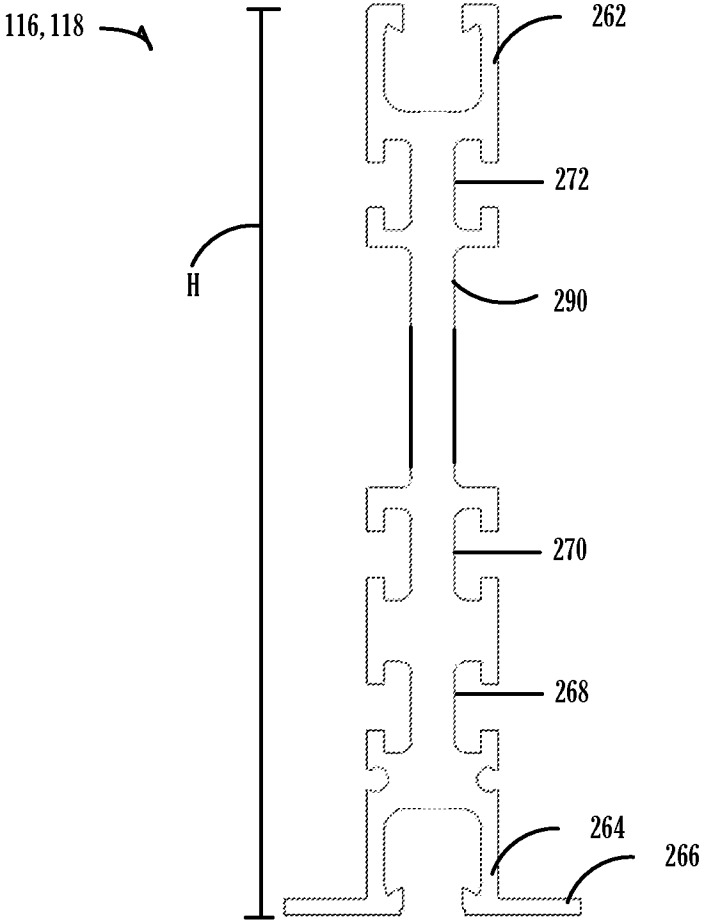
FIG. 2 is an end view of an example of an interior stick.

FIGS. 2 and 3 will be discussed together. FIG. 2 is an end view of an example of an interior stick (e.g., the runner sticks 116 or the cross sticks 118). FIG. 3 is a cross-sectional view of an example of a pair of perimeter sticks (e.g., the perimeter sticks 114) coupled together.

The interior sticks (e.g., the runner sticks 116 or the cross sticks 118) can include a superior attachment 262, an inferior attachment interface 264, a first pair of slots (slots 268), a second pair of slots (slots 270), and a third pair of slots (slots 272).

The superior attachment 262 can be configured to receive one or more attachment devices (as shown in FIG. 1 and FIGS. 6-9) to hang the ceiling support system 100 (FIG. 1) within a room. The superior attachment 262 can be a slot, groove, receptacle, or the like that can engage with one or more attachment devices along a length of the interior sticks (e.g., the third length 132 (FIG. 1) or the fourth length 134 (FIG. 1)). The superior attachment 262 can also be configured to secure and protect wiring or other utilities therein to distribute the utilities throughout the clean room.

The inferior attachment interface 264 can be configured to receive one or more attachment devices to hang devices from the interior sticks of the ceiling support system 100. In examples, the inferior attachment interface 264 can be configured to hold light fixtures, outlets, wiring, or the like, the extend them from the ceiling and into the clean room. The inferior attachment interface 264 can include flanges 266. The flanges 266 can be configured to hold ceiling tiles, drop ceiling, accessories, or the like within the clean room. Thus, the flanges 266 can extend from the inferior attachment interface 264 to provide a surface upon which the ceiling accessory can rest once the interior sticks and the ceiling accessory are installed within the clean room.

The slots 268 can be adjacent the inferior attachment interface 264, the slots 272 can be adjacent the superior attachment 262, and the slots 270 can be between the slots 268 and the slots 272. The slots (268, 270, and 272) can be configured to receive one or more fasteners to slidingly couple a mounting bracket (e.g., the first mounting bracket 120 (FIG. 1) or the second mounting bracket 122 (FIG. 1) to the interior sticks. As shown in FIG. 2, the slots (268, 270, and 272) can be the same size, such that, for example, each of the slots (268, 270, and 272) can receive the same fastener. In examples, the slots (268, 270, and 272) can be different sizes, such that, for example, one or more of the slots (268, 270, and 272) can receive one or more differently sized fasteners.

Each of the perimeter sticks (e.g., the perimeter sticks 114) can include a superior attachment interface 274, an inferior attachment interface 276, a first slot 280, a second slot 282, a third slot 284, and an aperture 286.

The superior attachment interface 274 of a single one of the perimeter sticks can be configured to receive an attachment device, such that, for example, when oppositely facing perimeter sticks are joined, the superior attachment interface 274 of the oppositely facing perimeter sticks can receive the attachment device to hang the ceiling support system 100 within a room. The superior attachment interface 274 of the oppositely facing perimeter sticks can form a slot, groove, receptacle, or the like that can engage with one or more attachment devices along a length of the perimeter sticks (e.g., the first length 126). The superior attachment interface 274 can also be configured to secure and protect wiring or other utilities therein to distribute the utilities throughout the clean room.

The inferior attachment interface 276 of a single one of the perimeter sticks can be configured to receive an attachment device, such that, for example, when oppositely facing perimeter sticks are joined, the inferior attachment interface 276 of the oppositely facing perimeter sticks can receive one or more attachment devices to hang devices from the interior sticks of the ceiling support system 100. In examples, the inferior attachment interface 276 can be configured to hold light fixtures, outlets, wiring, or the like, the extend them from the ceiling and into the clean room. The inferior attachment interface 276 can include a flange 278. The flange 278 of the oppositely facing perimeter sticks can be configured to hold ceiling tiles, drop ceiling, accessories, or the like within the clean room. Thus, the flanges 278 of oppositely facing perimeter sticks can extend from the inferior attachment interface 276 to provide a surface upon which the ceiling accessory can rest once the interior sticks and the ceiling accessory are installed within the clean room.

The slot 280 can be adjacent the inferior attachment interface 276, the slot 282 can be adjacent the slot 280 opposite the inferior attachment interface 276, the slot 284 can be adjacent the superior attachment interface 274, and the aperture 286 can be between the slot 282 and the slot 284. The slots (280, 282, and 284) can be configured to receive one or more fasteners to slidingly couple a mounting bracket (e.g., the first mounting bracket 120 (FIG. 1) or the second mounting bracket 122 (FIG. 1) to the interior sticks. As shown in FIG. 2, the slots (280, 282, and 284) can be the same size, such that, for example, each of the (280, 282, and 284) can receive the same fastener. In examples, the slots (280, 282, and 284) can be different sizes, such that, for example, one or more of the slots (280, 282, and 284) can receive one or more differently sized fasteners.

As shown in FIGS. 2 and 3, each perimeter stick (e.g., the perimeter sticks 114) can have a first cross-sectional profile 288, and each interior stick (e.g., the runner sticks 116 or the cross sticks 118) can have a second cross-sectional profile 290. In examples, the first cross-sectional profile 288 can be half of the second cross-sectional profile 290, such that, for example, two oppositely facing perimeter sticks can form the second cross-sectional profile 290.

The height H of the perimeter sticks 114, the runner sticks 116, and the cross sticks 118 can be adjusted to adjust the amount of load the ceiling support system 100 can support. For example, as the height H is increased, the ceiling support system 100 can support additional weight. As the height His decreased, the cost (due to reduced material usage in manufacturing the sticks) and weight of the ceiling support system 100 can be reduced.

Figure 5:
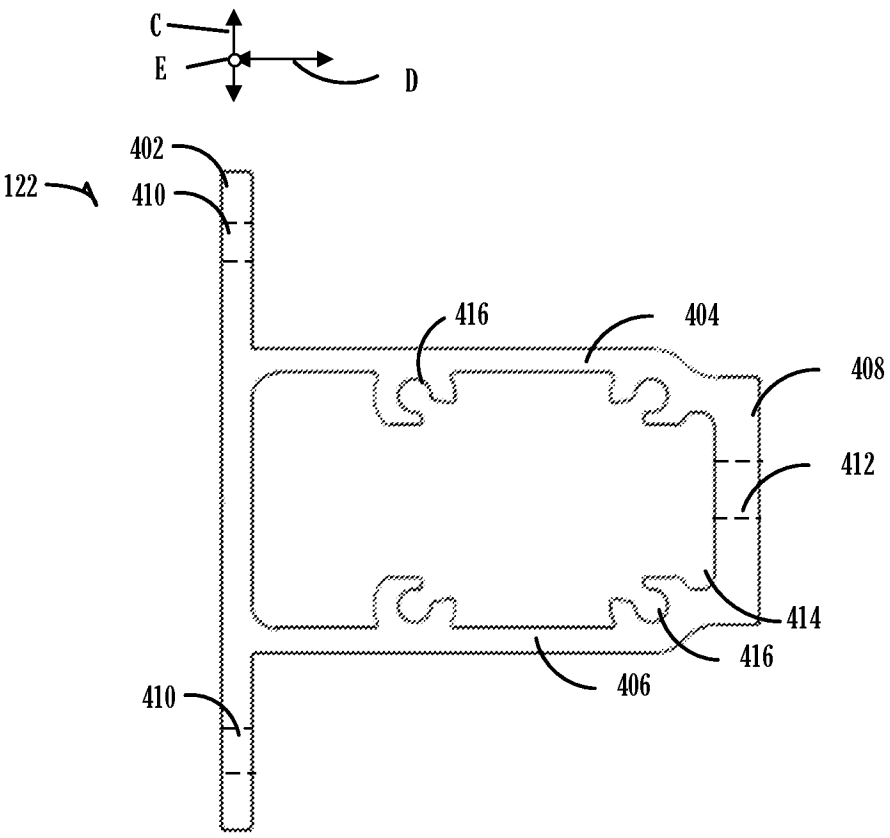
FIG. 5 is a top view of an example bracket.
Figure 4:
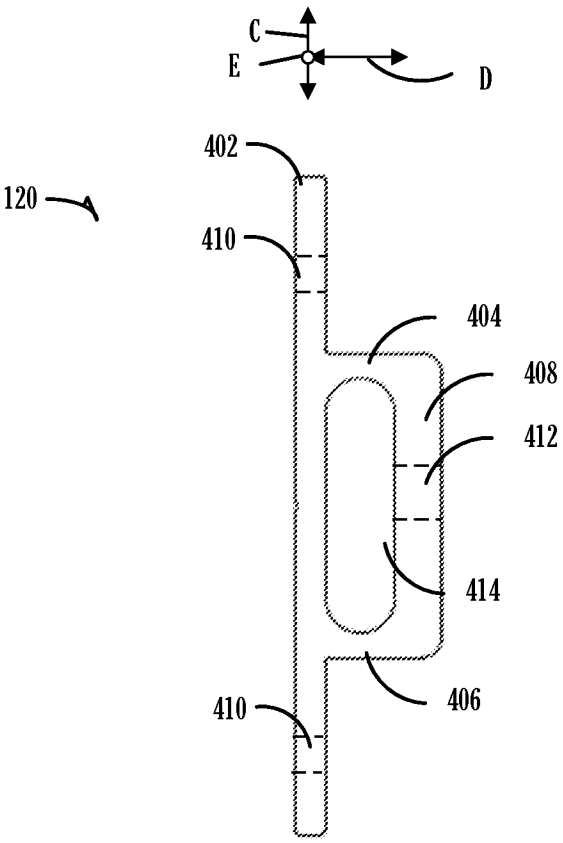
FIG. 4 is a top view of an example bracket.

FIGS. 4 and 5 will be discussed together. FIG. 4 is a top view of an example bracket (e.g., the first mounting bracket 120). FIG. 5 is a top view of an example bracket (e.g., the second mounting bracket 122).

The mounting brackets (e.g., the first mounting bracket 120 and the second mounting bracket 122) can provide structural support to the components of the ceiling support system 100 (FIG. 1). The mounting brackets (e.g., the first mounting bracket 120 and the second mounting bracket 122) can also help the ceiling support system 100 be modular such that the size of the ceiling support system 100 can be adjusted before or during installation. The mounting brackets (e.g., the first mounting bracket 120 and the second mounting bracket 122) also can allow the sections (e.g., the first section 110 (FIG. 1) and the second section 112 (FIG. 1), or the like) to be assembled in a location that is different from the location that the ceiling support system 100 is being installed. The mounting brackets (e.g., the first mounting bracket 120 and the second mounting bracket 122) can also allow individual sticks of the ceiling support system 100 to be removed at any time during assembly, installation, or after installation, without removing other sticks from the ceiling support system 100. The mounting brackets (e.g., the first mounting bracket 120 and the second mounting bracket 122) can include a base 402, a first wall 404, a second wall 406, an attachment interface 408 (shown in phantom).

The base 402 can extend in a direction C. The base 402 can include one or more apertures 410 (shown in phantom) formed therein. The one or more apertures 410 can be configured to receive one or more first fasteners to slidingly couple the mounting bracket 120 to any one of the perimeter sticks 114 (first shown in FIG. 1), the runner sticks 116 (first shown in FIG. 1), or the cross sticks 118 (first shown in FIG. 1).

The first wall 404 can extend substantially perpendicular from the base 402 in a direction D. The second wall 406 can extend substantially perpendicular from the base 402 and substantially parallel to the first wall 404 in the direction D. The first wall 404 can be spaced apart from the second wall 406 in the direction A.

The attachment interface 408 can extend from the first wall 404 to the second wall 406 opposite the base 402. The attachment interface 408 can be substantially parallel to the base 402 and substantially perpendicular to the first and second walls (404 and 406, respectively). The attachment interface 408 can include one or more apertures 412 formed therethrough. The one or more apertures 412 can be configured to receive one or more second fasteners to fixedly couple the mounting bracket (e.g., the first mounting bracket 120 or the second mounting bracket 122) to any one of the perimeter sticks 114 (first shown in FIG. 1), the runner sticks 116 (first shown in FIG. 1), or the cross sticks 118 (first shown in FIG. 1).

The base 402, the first wall 404, the second wall 406, and the attachment interface 408 can define a channel 414. The channel 414 can extend through the mounting bracket (e.g., the first mounting bracket 120 or the second mounting bracket 122) in a direction E. The direction E can be orthogonal to the direction C and the direction D, which can go into and out of the page. The channel 414 can be configured to receive an accessory therethrough.

As shown in FIG. 5, the first wall 404 or the second wall 406 can include attachment portions 416, which can be configured to receive a fastener to fixedly attach an accessory to the mounting bracket (e.g., the second mounting bracket 122). In examples, the attachment portions 416 can be configured to attach any accessory that can extend through the channel 414 of the mounting bracket.

Figure 7:
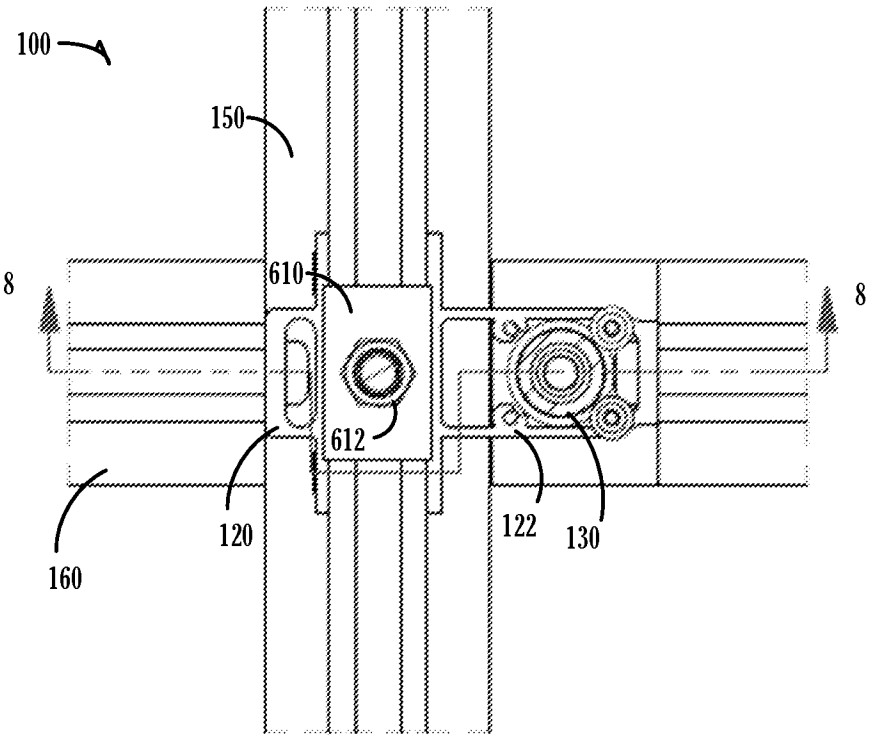
FIG. 7 illustrates a top view of an example of a ceiling support system.
Figure 6:
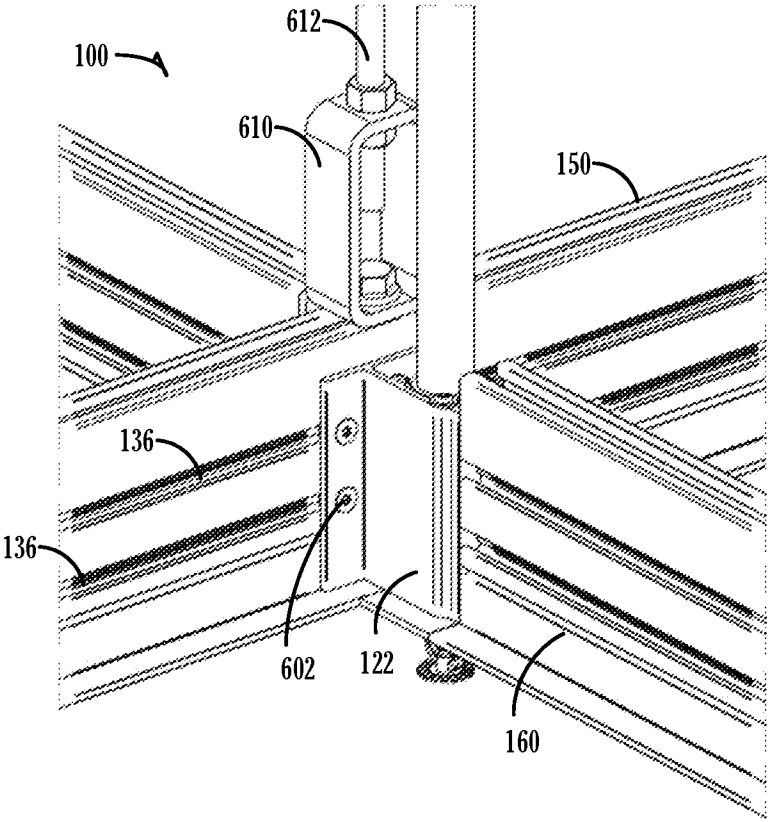
FIG. 6 is a zoomed-in perspective view of an example of a ceiling support system.
Figure 9:
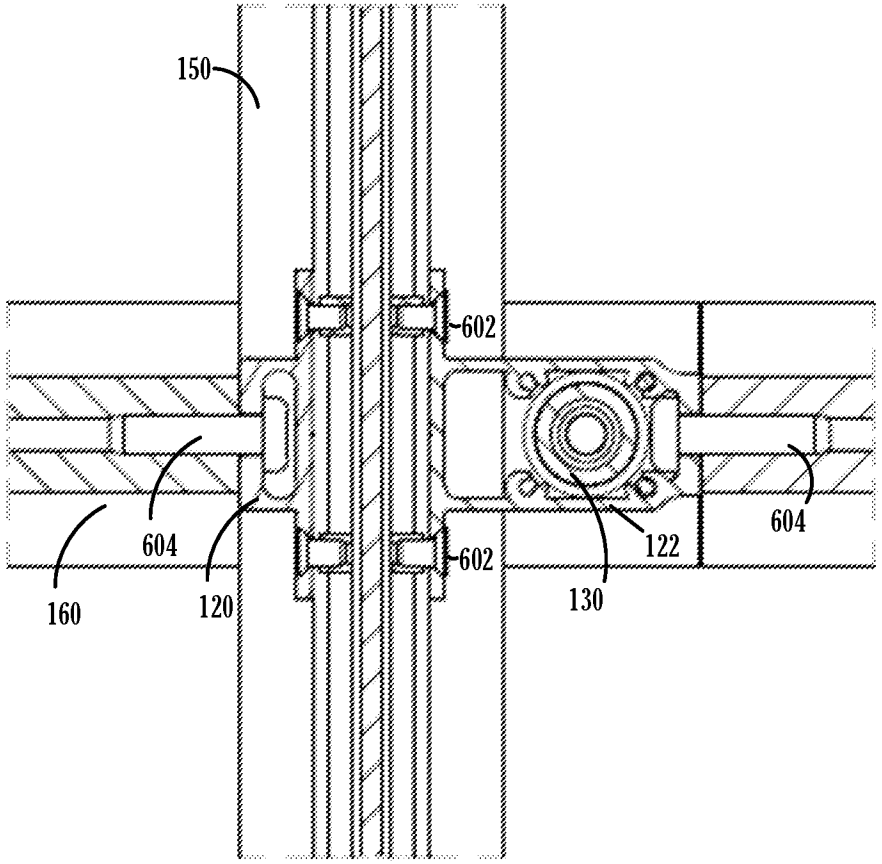
FIG. 9 is a cross-sectional view of a ceiling support system of FIG. 8 taken along line 9-9.
Figure 8:
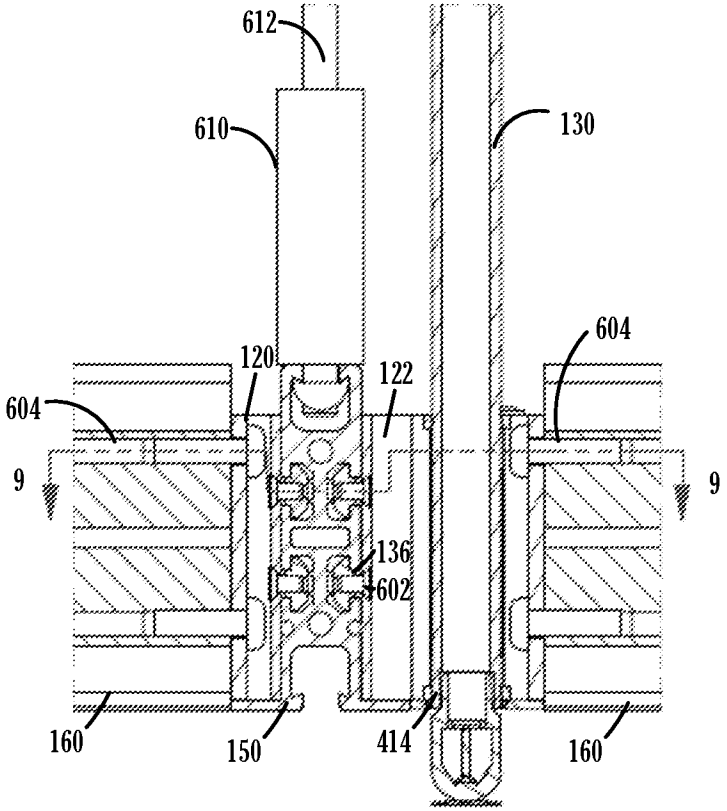
FIG. 8 illustrates a cross-sectional view of the ceiling support system of FIG. 7 taken along line 8-8.

FIGS. 6-9 will be discussed together. FIG. 6 is a zoomed-in perspective view of an example of the ceiling support system 100. FIG. 7 illustrates a top view of an example of the ceiling support system 100. FIG. 8 illustrates a cross-sectional view of the ceiling support system 100. of FIG. 7 taken along line 8-8. FIG. 9 is a cross-sectional view of the ceiling support system 100 of FIG. 8 taken along line 9-9.

Each of the perimeter sticks 114 (first shown in FIG. 1), the runner sticks 116 (first shown in FIG. 1), and the cross sticks 118 (first shown in FIG. 1) can include a slot 136. The slot 136 can be configured to receive a fastener 602. The fastener 602 can be configured to mount a mounting bracket (e.g., the first mounting bracket 120 or the second mounting bracket 122) to the respective stick. The mounting brackets (e.g., the first mounting bracket 120 or the second mounting bracket 122) can be configured to slidingly couple to a first stick 150 and fixedly couple to a second stick 160. The first stick 150 can be substantially perpendicular to the second stick 160. The first stick 150 any one of the perimeter sticks 114 or the runner sticks 116. The second stick 160 can be any one of the perimeter sticks 114, the runner sticks 116, or the cross sticks 118.

In examples, one or more fasteners 602 can be used to slidingly couple either of the first mounting bracket 120 or the second mounting bracket 122 to the first stick 150. Moreover, the one or more fasteners 604 can be used to fixedly couple the second stick 160 to the respective one of the first mounting bracket 120 or the second mounting bracket 122.

As shown in FIGS. 6-9, the ceiling support system 100 can include one or more hanging brackets 610. The one or more hanging brackets 610 can be attached to any of the first stick 150 or the second stick 160 to support the ceiling support system 100 and install the ceiling support system 100 within the room. The one or more hanging brackets 610 can be attached to one or more cables 612. Each of the one or more cables 612 can be secured to a structure (e.g., a ceiling, beam, or other support structure of the building, or the like). As discussed herein, the first section 110 can be secured to the second section 112 via one or more fasteners through the perimeter sticks 114 (as shown in FIG. 3).

Figure 10:
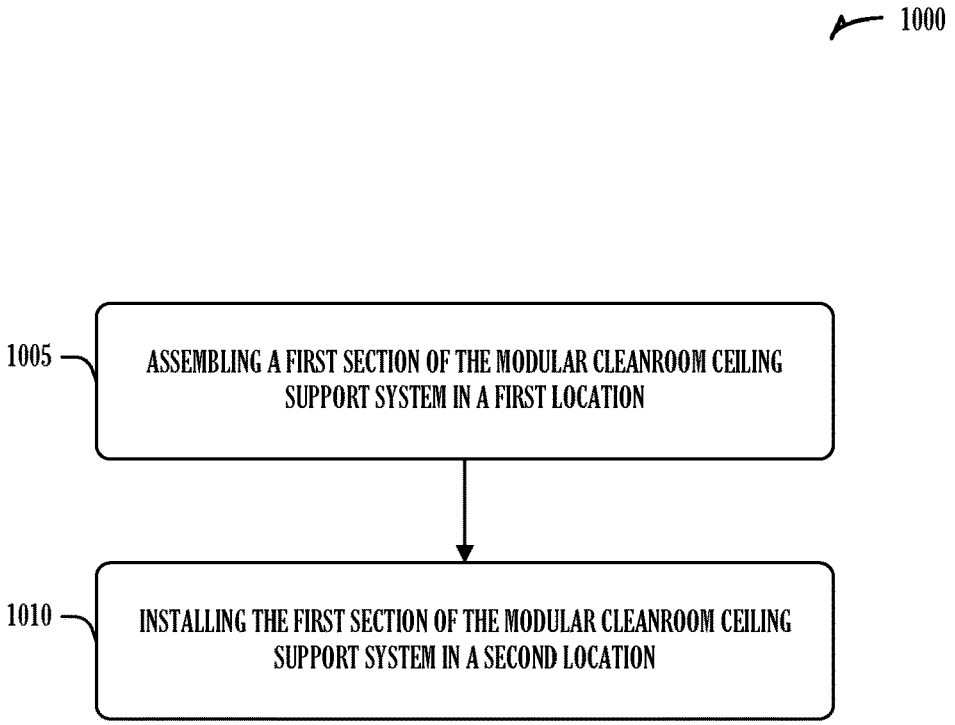
FIG. 10 is a schematic view of an example method of installing a clean room ceiling support system.

FIG. 10 illustrates a schematic view of the method 1000, in accordance with at least one example of this disclosure. The method 1000 can be a method of installing a modular cleanroom ceiling support system (e.g., the ceiling support system 100 (first shown in FIG. 1)). In examples, the method 1000 can include operations 1005 and 1010.

At operation 1005, the method 1000 can include assembling a first section of the modular cleanroom ceiling support system in a first location. For example, the method 1000 can include assembling the first section 110 (FIG. 1) of the ceiling support system 100 (FIG. 1) in a first location X (FIG. 1).

At operation 1010, the method 1000 can include installing the first section of the modular cleanroom ceiling support system in a second location. For example, the method 1000 can include installing the first section 110 of the ceiling support system 100 in the second location Y (FIG. 1).

As discussed herein, the first section can include a set of perimeter sticks configured to be assembled to define a perimeter of the first section. A set of interior runner sticks configured to be assembled within the perimeter defined by the set of perimeter sticks and orientated in a first direction. A set of interior cross sticks configured to be assembled within the perimeter defined by the set of perimeter sticks and orientated in a second direction. A first mounting bracket can be configured to connect any combination of perimeter and interior sticks. A second mounting bracket can be configured to connect any combination of perimeter and interior sticks. The second mounting bracket can be configured to secure an accessory received therethrough.

The method 1000 can also include, assembling a second section of the modular cleanroom ceiling support system in the first location X and installing the second section of the modular cleanroom ceiling support system in a third location. The third location adjacent to the second location Y (FIG. 1). Similar to the first section, the second section can include a set of perimeter sticks configured to be assembled to define a perimeter of the second section. A set of interior runner sticks configured to be assembled within the perimeter defined by the set of perimeter sticks and orientated in the first direction. A set of interior cross sticks configured to be assembled within the perimeter defined by the set of perimeter sticks and orientated in the second direction. A first mounting bracket can be configured to connect any combination of perimeter and interior sticks of the second section. A second mounting bracket can be configured to connect any combination of perimeter and interior sticks of the second section. The second mounting bracket can be configured to secure an accessory received therethrough.

In examples, assembling the first and second sections can include coupling, with one or more first fasteners, either of the first mounting bracket or the second mounting bracket to either a perimeter stick of the set of perimeter sticks or an interior runner stick of the set of interior runner sticks to slidingly couple the respective mounting bracket to the perimeter stick or the interior runner stick. Assembling the first and second sections can also include coupling, with the one or more second fasteners, any one of the perimeter sticks of the set of perimeter sticks, the interior runner stick of the set of interior runner sticks, or an interior cross stick of the set of interior cross sticks.

In examples, each of the first and second sections of the modular cleanroom ceiling support system includes one or more hanging brackets attached to any of the perimeter sticks of the set of perimeter sticks, interior runner sticks of the set of interior runner sticks, or interior cross sticks of the set of interior cross sticks. Thus, installing the first and second sections can include attaching the one or more hanging brackets to one or more cables, each of the one or more cables securable to a structure and coupling the first section to the second section.

The following, non-limiting examples, detail certain aspects of the present subject matter to solve the challenges and provide the benefits discussed herein, among others.

Example 1 is a modular cleanroom ceiling support system can include a ceiling support section that can include a set of perimeter sticks configured to be assembled to define a perimeter of the ceiling support section; a set of interior runner sticks configured to be assembled within the perimeter defined by the set of perimeter sticks and orientated in a first direction; a set of interior cross sticks configured to be assembled within the perimeter defined by the set of perimeter sticks and orientated in a second direction; a first mounting bracket configured to connect any combination of perimeter and interior sticks; and a second mounting bracket configured to connect any combination of perimeter and interior sticks, the second mounting bracket configured to secure an accessory received therethrough.

In Example 2, the subject matter of Example 1 can include, wherein the first direction is substantially perpendicular to the second direction.

In Example 3, the subject matter of Examples 1-2 can include, wherein each of the first mounting bracket and the second mounting bracket are configured to: slidingly couple to a first stick; and fixedly couple to a second stick, the second stick is substantially perpendicular to the first stick.

In Example 4, the subject matter of Example 3 can include, wherein the first stick is either a perimeter stick of the set of perimeter sticks or an interior runner stick of the set of interior runner sticks, and wherein the second stick is any one of the perimeter stick of the set of perimeter sticks, the interior runner stick of the set of interior runner sticks, or an interior cross stick of the set of interior cross sticks.

In Example 5, the subject matter of Example 4 can include, wherein the ceiling support section comprises a plurality of ceiling support sections, the plurality of ceiling support sections comprises: a first section; and a second section, each of the first section and the second section can be assembled in a first location and installed in a second location.

In Example 6, the subject matter of Example 5 can include, wherein each perimeter stick of the set of perimeter sticks has a first cross-sectional profile, and wherein each interior runner stick of the set of interior runner sticks and each interior cross stick of the set of interior cross sticks have a second cross-sectional profile.

In Example 7, the subject matter of Example 6 can include, wherein the first cross-sectional profile is half of the second cross-sectional profile such that two adjacent and oppositely facing perimeter sticks of the set of perimeter sticks form the second cross-sectional profile.

In Example 8, the subject matter of Examples 4-7 can include, wherein the set of perimeter sticks comprises: first and second perimeter sticks having a first length and assembled substantially parallel to one another; and third and fourth perimeter sticks having a second length, each of the third and fourth perimeter sticks are connected to the first perimeter stick and the second perimeter stick and assembled substantially parallel to one another and substantially perpendicular to the first and second perimeter sticks, wherein the first, second, third, and fourth perimeter sticks define the perimeter of the section.

In Example 9, the subject matter of Example 8 can include, wherein each interior runner stick of the set of interior runner sticks is configured to be assembled substantially parallel to the third perimeter stick and the fourth perimeter stick and substantially perpendicular to the first perimeter stick and the second perimeter stick.

In Example 10, the subject matter of Example 9 can include, wherein each interior cross stick of the set of interior cross sticks is configured to be assembled substantially parallel to the first perimeter stick and the second perimeter stick and substantially perpendicular to the third perimeter stick and the fourth perimeter stick.

In Example 11, the subject matter of Example 10 can include, wherein each interior runner stick of the set of interior runner sticks has a third length, and each interior cross stick of the set of interior cross sticks has a fourth length that is less than the third length.

In Example 12, the subject matter of Example 11 can include, wherein each interior runner stick of the set of interior runner sticks is assembled offset from one another within the perimeter and extending between and connected to either the first and second perimeter sticks or the third and fourth perimeter sticks.

In Example 13, the subject matter of Examples 11-12 can include, wherein each interior runner stick of the set of interior runner sticks is connected to the first and second perimeter sticks or the third and fourth perimeter sticks by any combination of two of the first or second mounting brackets.

In Example 14, the subject matter of Example 13 can include, wherein each interior cross stick of the set of interior cross sticks is assembled within the perimeter and is connected to: one of the first, second, third, or fourth perimeter sticks and one interior runner stick of the set of interior runner sticks; or a first interior runner stick of the set of interior runner sticks and a second interior runner stick of the set of interior runner sticks.

In Example 15, the subject matter of Example 14 can include, wherein each interior cross stick of the set of interior cross sticks is connected by any combination of two of the first or second mounting brackets.

In Example 16, the subject matter of Example 15 can include, wherein each perimeter stick of the set of perimeter sticks, each interior runner stick of the set of interior runner sticks, and each interior cross stick of the set of interior cross sticks each comprises a slot configured to receive a fastener configured to couple either a first mounting bracket or a second mounting bracket to the respective stick.

Example 17 is a mounting bracket for a modular cleanroom ceiling support system including a set of perimeter sticks, a set of interior runner sticks, and a set of interior cross sticks, the mounting bracket comprising: a base extending in a first direction and including one or more apertures formed therein, the one or more apertures configured to receive one or more first fasteners to slidingly couple the mounting bracket to any one of a perimeter stick of the set of perimeter sticks, an interior runner stick of the set of interior runner sticks; a first wall extending substantially perpendicular from the base in a second direction; a second wall extending substantially perpendicular from the base and substantially parallel to the first wall in the second direction, the first wall spaced apart from the second wall in the first direction; and an attachment interface extending from the first wall to the second wall opposite the base, the attachment interface is substantially parallel to the base and substantially perpendicular to the first and second walls, the attachment interface including one or more apertures formed therethrough, the one or more apertures formed in the attachment interface are configured to receive one or more second fasteners to fixedly couple the mounting bracket to any one of the perimeter stick of the set of perimeter sticks, the interior runner stick of the set of interior runner sticks, or an interior cross stick of the set of interior cross sticks.

In Example 18, the subject matter of Example 17 can include, wherein the base, the first wall, the second wall, and the attachment interface define a hollow section extending through the bracket in a third direction, the third direction is orthogonal to the first direction and the second direction.

In Example 19, the subject matter of Example 18 can include, wherein the hollow section is configured to receive an accessory therethrough.

In Example 20, the subject matter of Example 19 can include, wherein each of the first wall or the second wall comprises: an attachment portion configured to receive a fastener to fixedly attach the accessory to the mounting bracket.

In Example 21, the subject matter of Examples 19-20 can include, wherein each of the first wall or the second wall comprises: an attachment portion configured to receive a fastener to fixedly attach the accessory to the mounting bracket.

Example 22 is a method of installing a modular cleanroom ceiling support system, the method comprising: assembling a first section of the modular cleanroom ceiling support system in a first location; and installing the first section of the modular cleanroom ceiling support system in a second location; wherein the first section comprises: a set of perimeter sticks configured to be assembled to define a perimeter of the first section; a set of interior runner sticks configured to be assembled within the perimeter defined by the set of perimeter sticks and orientated in a first direction; a set of interior cross sticks configured to be assembled within the perimeter defined by the set of perimeter sticks and orientated in a second direction; a first mounting bracket configured to connect any combination of perimeter and interior sticks; and a second mounting bracket configured to connect any combination of perimeter and interior sticks, the second mounting bracket configured to secure an accessory received therethrough.

In Example 23, the subject matter of Example 22 can include, assembling a second section of the modular cleanroom ceiling support system in the first location; and installing the second section of the modular cleanroom ceiling support system in a third location, the third location adjacent to the second location; wherein the second section comprises: a set of perimeter sticks configured to be assembled to define a perimeter of the second section; a set of interior runner sticks configured to be assembled within the perimeter defined by the set of perimeter sticks and orientated in the first direction; a set of interior cross sticks configured to be assembled within the perimeter defined by the set of perimeter sticks and orientated in the second direction; a first mounting bracket configured to connect any combination of perimeter and interior sticks of the second section; and a second mounting bracket configured to connect any combination of perimeter and interior sticks of the second section, the second mounting bracket configured to secure an accessory received therethrough.

In Example 24, the subject matter of Example 23 can include, wherein assembling the first and second sections comprises: coupling, with one or more first fasteners, either of the first mounting bracket or the second mounting bracket to either a perimeter stick of the set of perimeter sticks or an interior runner stick of the set of interior runner sticks to slidingly couple the respective mounting bracket to the perimeter stick or the interior runner stick; and coupling, with the one or more second fasteners, any one of the perimeter stick of the set of perimeter sticks, the interior runner stick of the set of interior runner sticks, or an interior cross stick of the set of interior cross sticks.

In Example 25, the subject matter of Examples 23-24 can include, wherein each of the first and second sections of the modular cleanroom ceiling support system can include one or more hanging brackets attached to any of the perimeter sticks of the set of perimeter sticks, interior runner sticks of the set of interior runner sticks, or interior cross sticks of the set of interior cross sticks, and wherein installing the first and second sections comprises: attaching the one or more hanging brackets to one or more cables, each of the one or more cables securable to a structure; and coupling the first section to the second section.

Example 26 is an apparatus comprising means to implement of any of Examples 1-25.

Example 27 is a system to implement of any of Examples 1-25.

Example 28 is a method to implement of any of Examples 1-25.

Example 29 is an apparatus, system, or method of any element of any of Examples 1-25.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The term "about," as used herein, means approximately, in the region of, roughly, or around. When the term "about" is used in conjunction with a numerical range, it modifies that range by extending the boundaries above and below the numerical values set forth. In general, the term "about" is used herein to modify a numerical value above and below the stated value by a variance of 10%. In one aspect, the term "about" means plus or minus 10% of the numerical value of the number with which it is being used. Therefore, about 50% means in the range of 45%-55%. Numerical ranges recited herein by endpoints include all numbers and fractions subsumed within that range (e.g. 1 to 5 includes 1, 1.5, 2, 2.75, 3, 3.90, 4, 4.24, and 5). Similarly, numerical ranges recited herein by endpoints include subranges subsumed within that range (e.g. 1 to 5 includes 1-1.5, 1.5-2, 2-2.75, 2.75-3, 3-3.90, 3.90-4, 4-4.24, 4.24-5, 2-5, 3-5, 1-4, and 2-4). It is also to be understood that all numbers and fractions thereof are presumed to be modified by the term "about."

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is to allow the reader to quickly ascertain the nature of the technical disclosure and is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the embodiments should be determined with reference to the appended claims, along with the full scope of equivalents to which such claims are entitled.

The invention claimed is:

1. A cleanroom ceiling support system comprising:

a ceiling support section comprising:

a set of perimeter sticks configured to be assembled to define a perimeter of the ceiling support section;

a set of interior runner sticks configured to be assembled within the perimeter defined by the set of perimeter sticks and orientated in a first direction;

a set of interior cross sticks configured to be assembled within the perimeter defined by the set of perimeter sticks and orientated in a second direction;

a first mounting bracket configured to connect any combination of perimeter and interior sticks; and a second mounting bracket configured to connect any combination of perimeter and interior sticks;

wherein each perimeter stick of the set of perimeter sticks has a first cross-sectional profile, and wherein each interior runner stick of the set of interior runner sticks and each interior cross stick of the set of interior cross sticks have a second cross-sectional profile; and wherein the first cross-sectional profile is half of the second cross-sectional profile such that two adjacent and oppositely facing perimeter sticks of the set of perimeter sticks form the second cross-sectional profile.

2. The cleanroom ceiling support system of claim 1, wherein the second mounting bracket is configured to secure an accessory received therethrough.

3. The cleanroom ceiling support system of claim 1, wherein the first direction is substantially perpendicular to the second direction.

4. The cleanroom ceiling support system of claim 1, wherein each of the first mounting bracket and the second mounting bracket are configured to:

slidingly couple to a first stick; and fixedly couple to a second stick, the second stick is substantially perpendicular to the first stick.

5. The cleanroom ceiling support system of claim 4, wherein the first stick is either a perimeter stick of the set of perimeter sticks or an interior runner stick of the set of interior runner sticks, and wherein the second stick is any one of the perimeter stick of the set of perimeter sticks, the interior runner stick of the set of interior runner sticks, or an interior cross stick of the set of interior cross sticks.

6. The cleanroom ceiling support system of claim 5, wherein the ceiling support section comprises a plurality of ceiling support sections, the plurality of ceiling support sections comprises:

a first section; and a second section, each of the first section and the second section can be assembled in a first location and installed in a second location.

7. The cleanroom ceiling support system of claim 5, wherein the set of perimeter sticks comprises:

first and second perimeter sticks having a first length and assembled substantially parallel to one another; and third and fourth perimeter sticks having a second length, each of the third and fourth perimeter sticks are connected to the first perimeter stick and the second perimeter stick and assembled substantially parallel to one another and substantially perpendicular to the first and second perimeter sticks, wherein the first, second, third, and fourth perimeter sticks define the perimeter of the section.

8. The cleanroom ceiling support system of claim 7, wherein each interior runner stick of the set of interior runner sticks is configured to be assembled substantially parallel to the third perimeter stick and the fourth perimeter stick and substantially perpendicular to the first perimeter stick and the second perimeter stick.

9. The cleanroom ceiling support system of claim 8, wherein each interior cross stick of the set of interior cross sticks is configured to be assembled substantially parallel to the first perimeter stick and the second perimeter stick and substantially perpendicular to the third perimeter stick and the fourth perimeter stick.

10. The cleanroom ceiling support system of claim 9, wherein each interior runner stick of the set of interior runner sticks has a third length, and each interior cross stick of the set of interior cross sticks has a fourth length that is less than the third length.

11. The cleanroom ceiling support system of claim 10, wherein each interior runner stick of the set of interior runner sticks is assembled offset from one another within the perimeter and extending between and connected to either the first and second perimeter sticks or the third and fourth perimeter sticks.

12. The cleanroom ceiling support system of claim 10, wherein each interior runner stick of the set of interior runner sticks is connected to the first and second perimeter sticks or the third and fourth perimeter sticks by any combination of two of the first or second mounting brackets.

13. The cleanroom ceiling support system of claim 12, wherein each interior cross stick of the set of interior cross sticks is assembled within the perimeter and is connected to:

one of the first, second, third, or fourth perimeter sticks and one interior runner stick of the set of interior runner sticks; or a first interior runner stick of the set of interior runner sticks and a second interior runner stick of the set of interior runner sticks.

14. The cleanroom ceiling support system of claim 13, wherein each interior cross stick of the set of interior cross sticks is connected by any combination of two of the first or second mounting brackets.

15. The cleanroom ceiling support system of claim 14, wherein each perimeter stick of the set of perimeter sticks, each interior runner stick of the set of interior runner sticks, and each interior cross stick of the set of interior cross sticks each comprises a slot configured to receive a fastener configured to couple either a first mounting bracket or a second mounting bracket to the respective stick.

* * * * *